United States Patent [19]

Namiki

[11] 3,964,431

[45] June 22, 1976

[54] DEVICE FOR SUPPLYING AN OFFSET PREVENTING LIQUID TO A FIXING ROLLER

[75] Inventor: Ryoichi Namiki, Hino, Japan

[73] Assignee: Ricoh Co., Ltd., Tokyo, Japan

[22] Filed: May 17, 1974

[21] Appl. No.: 471,132

[30] Foreign Application Priority Data

June 1, 1973 Japan ..... 48-65619

[52] U.S. Cl. ..... 118/60; 118/262; 432/60; 432/228

[51] Int. Cl.[2] ..... G03G 15/20

[58] Field of Search ..... 118/60, 259, 260, 637, 118/DIG. 23; 117/17.5; 432/60, 228

[56] References Cited

UNITED STATES PATENTS

| | | | |
|---|---|---|---|
| 3,072,053 | 1/1963 | Becker et al. | 118/259 |
| 3,170,382 | 2/1965 | Schwab et al. | 118/259 |
| 3,449,548 | 6/1969 | Adamek et al. | 118/60 |
| 3,468,286 | 9/1969 | Nugarus | 118/259 |
| 3,716,018 | 2/1973 | Ohta et al. | 118/101 |
| 3,731,358 | 5/1973 | Artl | 118/60 |
| 3,745,972 | 7/1973 | Thettu | 118/261 |
| 3,810,776 | 5/1974 | Banks et al. | 432/60 |
| 3,811,821 | 5/1974 | Ariyama et al. | 118/60 |
| 3,841,827 | 10/1974 | Thettu | 118/260 |
| 3,902,845 | 9/1975 | Murphy | 118/60 |

*Primary Examiner*—Mervin Stein
*Assistant Examiner*—Douglas Salser
*Attorney, Agent, or Firm*—Cooper, Dunham, Clark, Griffin & Moran

[57] ABSTRACT

A device comprising an offset preventing liquid supply roller of a novel construction which is capable of supplying a suitable amount of offset preventing liquid in one operation to a fixing roller of an electrophotographic copying apparatus and remaining in sevice over a prolonged time by merely being maintained in contact with the fixing roller with a low force. The supply roller comprises a reservoir disposed in its central portion for containing therein a substantial amount of offset preventing liquid, and a liquid permeable material layer disposed outwardly of the reservoir and capable of being permeated with the offset preventing liquid for supplying to the fixing roller the offset preventing liquid which oozes therethrough.

3 Claims, 6 Drawing Figures

DEVICE FOR SUPPLYING AN OFFSET PREVENTING LIQUID TO A FIXING ROLLER

BACKGROUND OF THE INVENTION

This invention relates to a device for supplying an offset preventing liquid to a fixing roller of a heating and fixing device of electrophotographic copying apparatus for preventing the occurence of a so-called offset phenomenon.

In the heating and fixing device, a powder image formed on a sheet is melted and becomes tacky. At this time, a portion or portions of such powder image may adhere to the fixing roller particularly when the fixing roller is in the form of a heating and fixing roller. As a result, such portion or portions will be transferred from the roller to a sheet which is supplied following the last previously supplied sheet to the heating and fixing device and become deposited thereon. This is what is generally referred to as an offset phenomenon.

This disadvantage can be eliminated by making the roller from a material which is free from the danger of causing the offset phenomenon to occur. No such material has, however, been discovered yet. Thus, it is usual practice nowadays to apply an offset preventing liquid to the surface of the roller as a means for preventing the occurrence of the offset phenomenon in electrophotographic copying apparatus.

FIG. 1 shows a prior art device for applying an offset preventing liquid to a heating and fixing roller which has been commonly in use. In the figure, the numeral 1 designates a heating and fixing roller coated on its outer periphery with Teflon (trade name) and maintained in pressing contact with a roller 2 which houses therein a heater (not shown). The two rollers rotate in opposite directions as indicated by arrows. An offset preventing liquid supplying cloth 4 immersed at one end portion in an offset preventing liquid 3 is maintained at the other end portion in contact with the outer periphery of the roller 1 so as to supply the offset preventing liquid 3 to the roller 1.

The device of the prior art shown and described hereinabove has the disadvantages of being cumbersome in construction and unable to supply a suitable amount of offset preventing liquid 3 in one operation to the heating and fixing roller 1, the amount delivered varying from one operation to another.

It has recently been discovered that the frequency of occurrence of the offset phenomenon can be lowered by coating the heating and fixing roller with silicone rubber which is superior to Teflon (trade name) in being less susceptible to the adhesion of particles forming a powder image in electrophotography. It is notable that it is possible completely to prevent the occurrence of the offset phenomenon by coating the heating and fixing roller with silicone rubber and applying thereto an offset preventing liquid, and that the amount of offset preventing liquid required for each operation can be greatly reduced.

This invention is based on the aforementioned discovery that the amount of offset preventing liquid used for each operation is very small when the heating and fixing roller is coated with silicone rubber.

SUMMARY OF THE INVENTION

This invention has as its object the provision of a device for supplying an offset preventing liquid to a fixing roller of a heating and fixing device of electrophotographic copying apparatus which obviates the aforementioned disadvantages of the prior art.

With the device according to the invention, a suitable amount of offset preventing liquid can be supplied in one operation to the fixing roller and the offset preventing operations can be performed over a prolonged period of time without requiring to replace the offset preventing liquid supply roller by a new one. Moreover, the device occupies no more space than is necessary, thereby enabling to obtain a compact overall size in a heating and fixing device of electrophotographic apparatus.

Additional and other objects and advantages of the invention will become evident from the description set forth hereinafter when considered in conjunction with the accompanying drawings.

DESCRIPTION OF THE PREFERRED EMBODIMENTS

Figure 1:
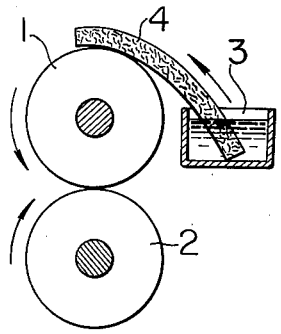
FIG. 1 is a side view of an offset preventing liquid supplying device of the prior art.
Figure 2:
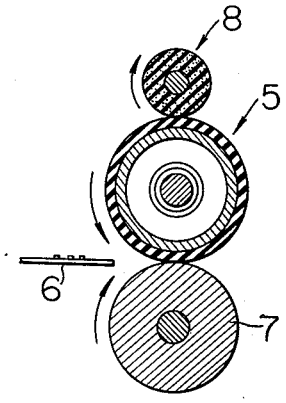
FIG. 2 is a sectional side view of the offset preventing liquid supply roller of the offset preventing liquid supply device according to the invention arranged relative to the heating and fixing roller and the pressure applying roller of the fixing device.

The invention will now be described in detail with reference to the embodiments shown in the accompanying drawings. In FIG. 2, an offset preventing liquid supply roller 8 impregnated with an offset preventing liquid is maintained in contact with a heating and fixing roller 5 having an outer peripheral layer made of a silicone rubber which in turn is maintained in contact with a pressure applying roller 7. All the rollers 8, 5 and 7 rotate respectively in directions indicated by arrows, while a copy sheet 6 is nipped by the rollers 5 and 7 and moves through the copy sheet path formed therebetween.

Figure 3:
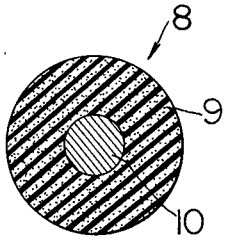
FIG. 3 to FIG. 6 show modifications of the device according to the invention.

FIG. 3 shows the construction of the offset preventing liquid supply roller 8 in detail. As shown, it comprises a porous material portion 9 made of foamed silicone rubber and accounting for the major portion of the roller, and a shaft 10. The porous material portion 9 is impregnated with silicone oil or other offset preventing liquid. By selecting an offset preventing liquid of suitable viscosity, it is possible to enable the porous material 9 to be impregnated with a required amount of offset preventing liquid and to permit the liquid thus contained in pores thereof to ooze therefrom in suitable amount. Besides foamed silicone rubber, foamed oil containing acetal, foamed phenol resin and the like may be used for making the porous material portion 9.

As the offset preventing liquid supply roller 8 rotates, the offset preventing liquid contained in the pores of the porous material portion 9 oozes therethrough to appear on its outer periphery, so that a suitable amount of offset preventing liquid can be applied in one operation to the outer periphery of the heating and fixing roller 5.

Figure 4:
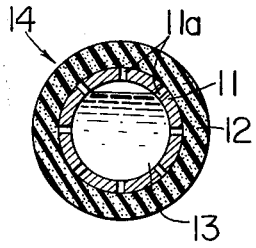

FIG. 4 shows a modification of the offset preventing liquid supply roller according to the invention. The offset preventing liquid supply roller 14 shown in the figure comprises a hollow cylindrical member 11, made of a metallic or synthetic resinous material and formed therein with a number of small openings 11*a*, which serves as a reservoir for an offset preventing liquid, and a liquid permeable material layer 12 formed on the outer periphery of the cylindrical member 11. An offset preventing liquid 13 is contained in the cylindrical member 11. The liquid permeable material layer 12 is made from a foamed material similar to that from which the porous material portion 9 shown in FIG. 3 is made. The offset preventing liquid 13 moving through the small openings 11a passes through the layer 12 and supplied to the outer periphery of a heating and fixing roller (not shown).

Figure 5:
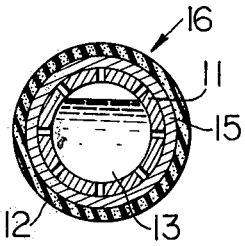

In order to preclude excessive outflow of the offset preventing liquid 13 through the small openings 11a, an additional layer 15 (FIG. 5) formed of felt, glass fibers, carbon fibers and other liquid impregnable material may be provided between the hollow cylindrical member 11 and the liquid permeable material layer 12. The numeral 16 generally designates a roller of this type.

Figure 6:
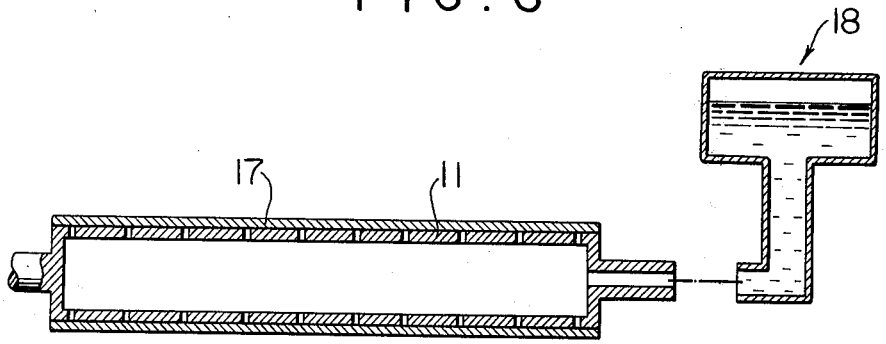

It has been ascertained by experiments that silicone rubber permits silicone oil to pass therethrough, although the amount of silicone oil passing therethrough is very small. Thus, silicone rubber may undergo swelling to a certain degree but it is not melted. Therefore, the liquid permeable material layer formed on the outer periphery of the cylindrical member 11 may be in the form of a silicone rubber layer 17 of small thickness as shown in FIG. 6. The same results can be obtained by using the silicone rubber layer 17 in supplying the offset preventing liquid 13 to the outer periphery of the heating and fixing roller. When the silicone rubber layer 17 is used, the openings formed in the cylindrical member 11 may be minuscule openings. When the cylindrical member 11 is made of a sintered alloy material, formation of the minuscule openings can be dispensed with.

The hollow cylindrical member 11 for containing the offset preventing liquid 13 therein may be sealed after being filled with the liquid 13. If necessary, however, the hollow cylindrical member 13 may be connected by suitable means to an offset preventing liquid tank 18 as shown in FIG. 6.

From the foregoing description, it will be appreciated that, with the device according to the invention, the offset preventing liquid passing through the liquid permeable material layer from the interior of the offset preventing liquid supply roller to the outer periphery thereof can be supplied to the outer periphery of the heating and fixing roller in a suitable amount in one operation as the rollers rotate while being maintained in pressing engagement with each other. The device according to the invention is not cumbersome and does not occupy more space than is necessary. Thus, marked advantages can be obtained by the use of this device.

An additional advantage offered by the invention lies in that, when the liquid permeable material layer of the offset preventing liquid supply roller is made from silicone rubber, minuscule particles of dust present on the surface of the heating and fixing roller can be made to move into the roller in virtue of the action of silicone rubber to cause the dust to migrate which is usually referred to as an amoebacan action. Thus, the offset preventing liquid supply roller can concurrently serve as a cleaning roller.

What is claimed is:

1. A fuser device in electrophotographic copying apparatus, comprising:

a. a fuser roller having a surface of silicone rubber;

b. a pressure roller engaging said fuser roller to provide a nip therebetween through which is passed a copy sheet electrostatically bearing a toner image oriented for contact with the peripheral surface of the fuser roller;

c. means for heating said toner image in said nip to fuse the image into the copy sheet; and d. an applicator roller disposed in rolling contact with said surface of said fuser roller and including i. means for retaining an offset-preventing liquid, and ii. a liquid-permeable material layer forming the periphery of said applicator roller for permitting said liquid to pass therethrough and to be supplied to said surface of the fuser roller at a very slow rate, e. said retaining means being made from a material capable of being impregnated with a substantial amount of said offset-preventing liquid.

2. A fuser device in electrophotographic copying apparatus, comprising:

a. a fuser roller having a surface of silicone rubber;

b. a pressure roller engaging said fuser roller to provide a nip therebetween through which is passed a copy sheet electrostatically bearing a toner image oriented for contact with the peripheral surface of the fuser roller;

c. means for heating said toner image in said nip to fuse the image into the copy sheet; and d. an applicator roller disposed in rolling contact with said surface of said fuser roller and including i. means for retaining an offset-preventing liquid, and ii. a liquid-permeable material layer forming the periphery of said applicator roller for permitting said liquid to pass therethrough and to be supplied to said surface of the fuser roller at a very slow rate, e. said retaining means comprising a hollow cylindrical member which backs up said liquid-permeable material layer and which is capable of not only containing said offset-preventing liquid therein but also permitting said offset-preventing liquid to move to said liquid-permeable material layer, and f. said applicator roller further including an additional layer interposed between said liquid-permeable material layer and said hollow cylindrical member and made from a material capable of maintaining the amount of said offset-preventing liquid moving from said member to said liquid permeable layer at a suitable level.

3. A fuser device in electrophotographic copying apparatus, comprising:

a. a fuser roller having a surface of silicone rubber;

b. a pressure roller engaging said fuser roller to provide a nip therebetween through which is passed a copy sheet electrostatically bearing a toner image oriented for contact with the peripheral surface of the fuser roller;

c. means for heating said toner image in said nip to fuse the image into the copy sheet; and d. an applicator roller disposed in rolling contact with said surface of said fuser roller and including i. means for retaining an offset-preventing liquid, and ii. a liquid-permeable material layer forming the periphery of said applicator roller for permitting said liquid to pass therethrough and to be supplied to said surface of the fuser roller at a very slow rate, e. said liquid-permeable material layer being made from silicone rubber and having a thickness such that it is permeable to said offset-preventing liquid in an amount corresponding to that required to be supplied to said fuser roller in one operation;

f. said offset-preventing liquid comprising silicone oil.

* * * * *